US010844653B2

(12) United States Patent
Ivasiv et al.

(10) Patent No.: US 10,844,653 B2
(45) **Date of Patent: *Nov. 24, 2020**

(54) MOLDED PLASTIC ACCESS DOOR

(71) Applicant: IVM HOMESTYLE LTD., Mississauga (CA)

(72) Inventors: Vitaliy Ivasiv, Mississauga (CA); Igor Ivasiv, Mississauga (CA)

(73) Assignee: IVM HOMESTYLE LTD., Mississauga (CA)

( * ) Notice: Subject to any disclaimer, the term of this patent is extended or adjusted under 35 U.S.C. 154(b) by 39 days.

This patent is subject to a terminal disclaimer.

(21) Appl. No.: 15/790,867

(22) Filed: Oct. 23, 2017

(65) Prior Publication Data

US 2018/0044974 A1 Feb. 15, 2018

Related U.S. Application Data

(63) Continuation of application No. 14/523,472, filed on Oct. 24, 2014, now Pat. No. 9,816,312, which is a (Continued)

(51) Int. Cl.
*E05C 21/02* (2006.01)
*E06B 5/01* (2006.01)
(Continued)

(52) U.S. Cl.
CPC ..... *E06B 5/01* (2013.01); *E05B 61/00* (2013.01); *E05B 65/006* (2013.01); *E05C 3/042* (2013.01);
(Continued)

(58) Field of Classification Search
CPC ..... E05B 5/01; E05B 61/00; E05B 65/006; E06B 3/70; E05D 11/00
(Continued)

(56) References Cited

U.S. PATENT DOCUMENTS 1,925,635 A 9/1932 Cyril
2,100,928 A 11/1937 Way
(Continued)

FOREIGN PATENT DOCUMENTS

EP 1582656 10/2005
GB 2185053 7/1987

OTHER PUBLICATIONS

2006 Camec Catalogue, pp. 174-176.

*Primary Examiner* — Jerry E Redman
(74) *Attorney, Agent, or Firm* — Bereskin & Parr LLP/S.E.N.C.R.L., S.R.L.

(57) ABSTRACT

A molded access door assembly for an access opening in a covering material of a wall or ceiling is disclosed. The door assembly includes a frame defining a frame opening. The frame is positionable against the covering material with the frame opening in alignment with the access opening. The frame includes a lip extending about a perimeter of the frame opening for bearing against the covering material adjacent the access opening, and a plurality of fastener holes passing through the lip for receiving fasteners to secure the frame against the covering material. The door assembly further includes a molded door hingedly connected to the frame. The door is movable between an open position providing access to the frame opening and the fastener holes, and a closed position in which the door covers the frame opening and an entirety of the fastener holes.

16 Claims, 5 Drawing Sheets

Related U.S. Application Data continuation of application No. 12/722,383, filed on Mar. 11, 2010, now Pat. No. 8,869,458.

(51) Int. Cl.

| | |
|---|---|
| ***E05C 3/04*** | (2006.01) |
| ***E05B 61/00*** | (2006.01) |
| ***E05B 65/00*** | (2006.01) |
| ***E05D 11/00*** | (2006.01) |
| ***E06B 3/70*** | (2006.01) |
| *E05D 1/06* | (2006.01) |
| *E05D 9/00* | (2006.01) |
| *E06B 7/22* | (2006.01) |

(52) U.S. Cl.

CPC ..... *E05D 11/00* (2013.01); *E06B 3/70* (2013.01); *E05D 1/06* (2013.01); *E05D 9/005* (2013.01); *E05Y 2900/132* (2013.01); *E06B 7/22* (2013.01); *E06B 2003/7082* (2013.01)

(58) Field of Classification Search

USPC ..... 49/397, 400, 463, 465, 501, 503

See application file for complete search history.

(56) References Cited

U.S. PATENT DOCUMENTS

| | | | | |
|---|---|---|---|---|
| 3,130,651 | A | 4/1964 | Werner | |
| 4,105,136 | A | 8/1978 | May | |
| 4,106,236 | A | 8/1978 | Oliphant | |
| 4,280,434 | A | 7/1981 | Beckerer, Jr. | |
| 4,846,089 | A | 7/1989 | Cedergreen | |
| 4,915,638 | A | 4/1990 | Domian | |
| D348,316 | S | 6/1994 | Malmanger et al. | |
| 5,327,682 | A | 7/1994 | Holtz | |
| 5,653,061 | A | 8/1997 | Hiner | |
| 6,273,288 | B1 | 8/2001 | Jarvis | |
| 7,168,146 | B2 | 1/2007 | Hord | |
| 8,115,100 | B2 | 2/2012 | Peckham | |
| 8,745,926 | B2 | 6/2014 | De Domenico | |
| 8,869,458 | B2 * | 10/2014 | Ivasiv | E05C 3/042 49/503 |
| 9,816,312 | B2 * | 11/2017 | Ivasiv | E05C 3/042 |
| 2009/0300884 | A1 | 12/2009 | Morgan et al. | |
| 2011/0067897 | A1 | 3/2011 | Peckham | |

* cited by examiner

MOLDED PLASTIC ACCESS DOOR

CROSS-REFERENCE TO RELATED APPLICATIONS

This application is a continuation of U.S. patent application Ser. No. 14/523,472, filed Oct. 24, 2014 and issued as U.S. Pat. No. 9,816,312, which is a continuation of U.S. patent application Ser. No. 12/722,383, filed Mar. 11, 2010 and issued as U.S. Pat. No. 8,869,458.

FIELD

The present invention relates to access doors for openings in covering material of walls or ceilings to permit access to services within a wall or ceiling cavity. In particular, the present invention is directed to a molded plastic access door for such openings.

BACKGROUND

In residential and commercial construction, services such as water supply, drain waste vent (DWV), natural gas and electrical service are generally run within a wall or ceiling cavity. The wall or ceiling cavity is covered with a finish material (also referred to as a covering material) such as a gypsum board to provide a finished appearance to the space. In many circumstances, it is required that access to valves, drains and connectors utilizing these services is maintained. In these situations, an opening is cut in the covering material of a size to permit access to the valve, drain or other connection. This opening is then covered by an access panel or access door which maintains the finished surface appearance while permitting access to the wall or ceiling cavity behind the panel or door.

There are presently available access panels of a molded plastic material where the access panel is provided with a spring clip on the back surface. The spring clip engages the interior surface of the covering material and sandwiches the covering material between the access panel and the spring clip. While such access panels may be relatively easy to install, they may not provide for a secure installation in that it may be difficult to lock the panel to control access to the cavity opening. Also, the spring clip may loosen from the access panel with repeated use such that the average useful life of such panels may be about 2 to 3 years.

Access doors constructed of metal are also known. The access doors constructed of metal are generally provided with an exterior frame having an L-shaped cross section with one leg of the L forming the exterior surface to overlie the wall or ceiling covering material. The other leg of the L is provided with holes to allow for fastening of the access door to the opening in the wall or ceiling. Owing to the weight of the metal panels, it may be necessary to provide for support such as wood strapping attached to the interior surface of the covering material if the opening does not line up with an existing stud or joist in the wall or ceiling cavity. The metal door may be provided with a hinge along one edge which is attached to one side of the frame, the door also having a locking means on the opposite side from the hinge to allow it to be closed and locked to the frame. The access door can fit within the frame but may not be airtight or soundproof.

Recently, plastic access doors have also been developed. These plastic access doors have an L-shaped frame similar to the metal access doors and the door itself is hinged in the opening by hinge pins which are placed interior of the edge of the door. While plastic access doors may have a lower weight than the traditional metal access doors, they may suffer from certain disadvantages. Owing to the design of the door, similar to the metal access doors, the plastic access door may not be airtight or soundproof. In addition, due to the placement of the hinges, the access door in the open position may block off access to a significant portion of the opening and may not provide access to the full width of the opening. The access door may also be installed similar to the metal access doors by attaching to strapping placed on the interior surface of the covering material.

There thus remains a need for a light weight plastic access door which may overcome one or more of the disadvantages of the prior art designs.

SUMMARY

According to some aspects, a molded access door assembly for an access opening in a wall or ceiling is disclosed. The access opening may be in a covering material of the wall or ceiling. The molded access door assembly can include a molded frame and a molded door hingedly connected to the frame. The frame includes a frame channel to form the outside of the access door assembly, the frame channel having spaced apart exterior and interior walls (also referred to as outside and inside walls, or outer and inner walls, respectively) joined at respective top edges by a top wall. The opening in the channel is orientated toward the covering material of the wall or ceiling. The frame channel has a lip extending from the bottom edge of the inner wall into the interior of the opening in the covering material of the wall or ceiling. The lip provides a stop rest for the door in the closed position and is provided with a means of attaching the access door assembly to the wall or ceiling. The door has a top surface and a first part of a hinge assembly along one edge of the top surface which cooperates with a matching second part of the hinge assembly along one edge of the frame channel to allow the door to move between an open and a closed position.

In some examples, the door assembly includes a means for releasably securing the door to the frame in the closed position.

In some examples, the means for releasably securing the door to the frame includes a rotatable latch which engages a latch receiving detent provided on the lip of the frame.

In some examples, the latch receiving detent is raised above the lip to provide a space between the bottom of the detent and the covering material to receive the rotatable latch.

In some examples, the tab includes a raised tab which engages a recess provided in the underside of the latch receiving detent.

In some examples, the first part of the hinge assembly has a generally circular hinge member with hinge pins protruding from both ends of the generally circular hinge member.

In some examples, the matching second part of the hinge assembly includes a cutout in the frame channel of the frame sized to accept the generally circular hinge member of the door.

In some examples, the door has a top surface (also referred to as a door top surface) and a wall (also referred to as a door wall or skirt) extending downwardly from the top surface around the edge of the top surface, the height of the wall being about equal to the height of the inside wall of the frame above the lip.

In some examples, resilient sealing material is provided on a lower edge of the door wall or on the lip to facilitate airtight or soundproof sealing between the lower edge of the door wall and the lip.

In some examples, the access door assembly is molded from any suitable thermosetting or thermoplastic material such as polyvinylchloride, polystyrene, polyamides, or ABS.

In some examples, the access door assembly is molded from an ABS material which can be colored to a suitable color to match the desired decor.

BRIEF DESCRIPTION OF THE DRAWINGS

Examples of the present invention are illustrated in the attached drawings in which.

DETAILED DESCRIPTION

Figure 1:
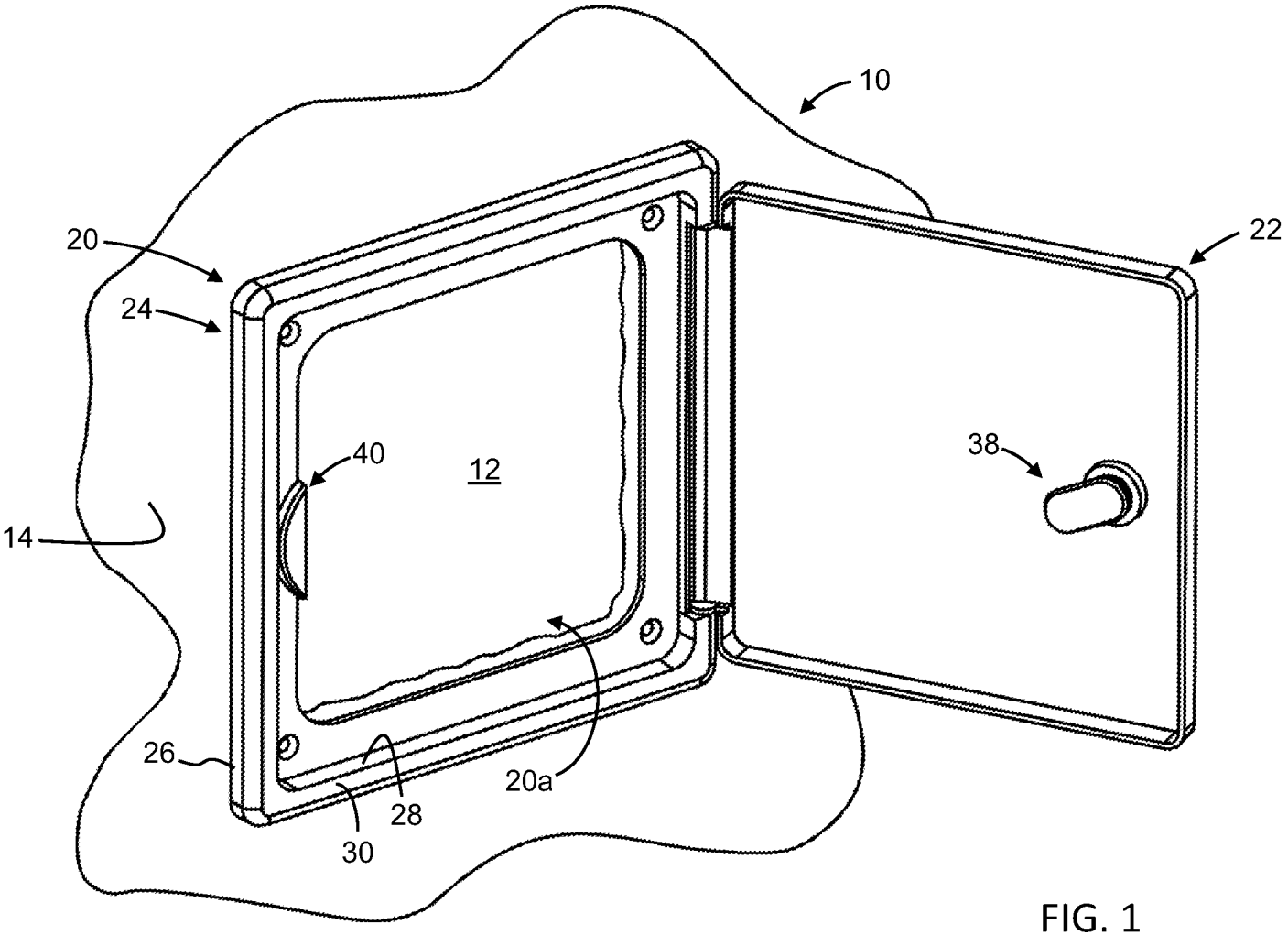
FIG. 1 is a perspective view of an example plastic access door assembly attached to a covering material of a wall, with the door assembly shown in an open condition.

An example access door assembly is illustrated in the attached drawings, generally indicated by numeral 10. Referring to FIG. 1, in the example illustrated, the access door assembly 10 is for attachment to a wall or ceiling surface to cover an opening 12 provided in a covering material 14 of the wall or ceiling to allow access to services provided within the cavity of the wall or ceiling behind the covering material 14.

In the example illustrated, the access door assembly 10 includes a frame assembly 20 (also referred to as a frame 20) to which is hingedly attached a door 22. The frame 20 defines a frame opening 20*a*. The frame 20 is positionable against the covering material 14 with the frame opening 20*a* in alignment with the access opening 12. The frame 20 includes a frame channel 24 having an outside wall 26 (also referred to as outer wall 26), an inside wall 28 (also referred to as inner wall 28), and a top wall 30. The frame channel 24 is orientated such that an open bottom between the outside wall 26 and the inside wall 28 is orientated towards the covering material 14 when the access door assembly 10 is installed. The provision of the frame channel 24 may increase the rigidity of the frame assembly 20, and in turn the entire access door assembly 10, without necessarily increasing weight or cost.

In this description, reference to a "lateral" direction with respect to the access door 10 is a direction generally parallel to the covering material 14 of the wall or ceiling on which the access door 10 is installed. The reference to a "vertical" direction with respect to the access door 10 is a direction generally orthogonal to the covering material 14, and the terms "bottom" and "top" refer to positions spaced apart generally orthogonally relative to the covering material 14, with "bottom" being nearer to, and "top" being further from, the covering material 14.

Figure 2:
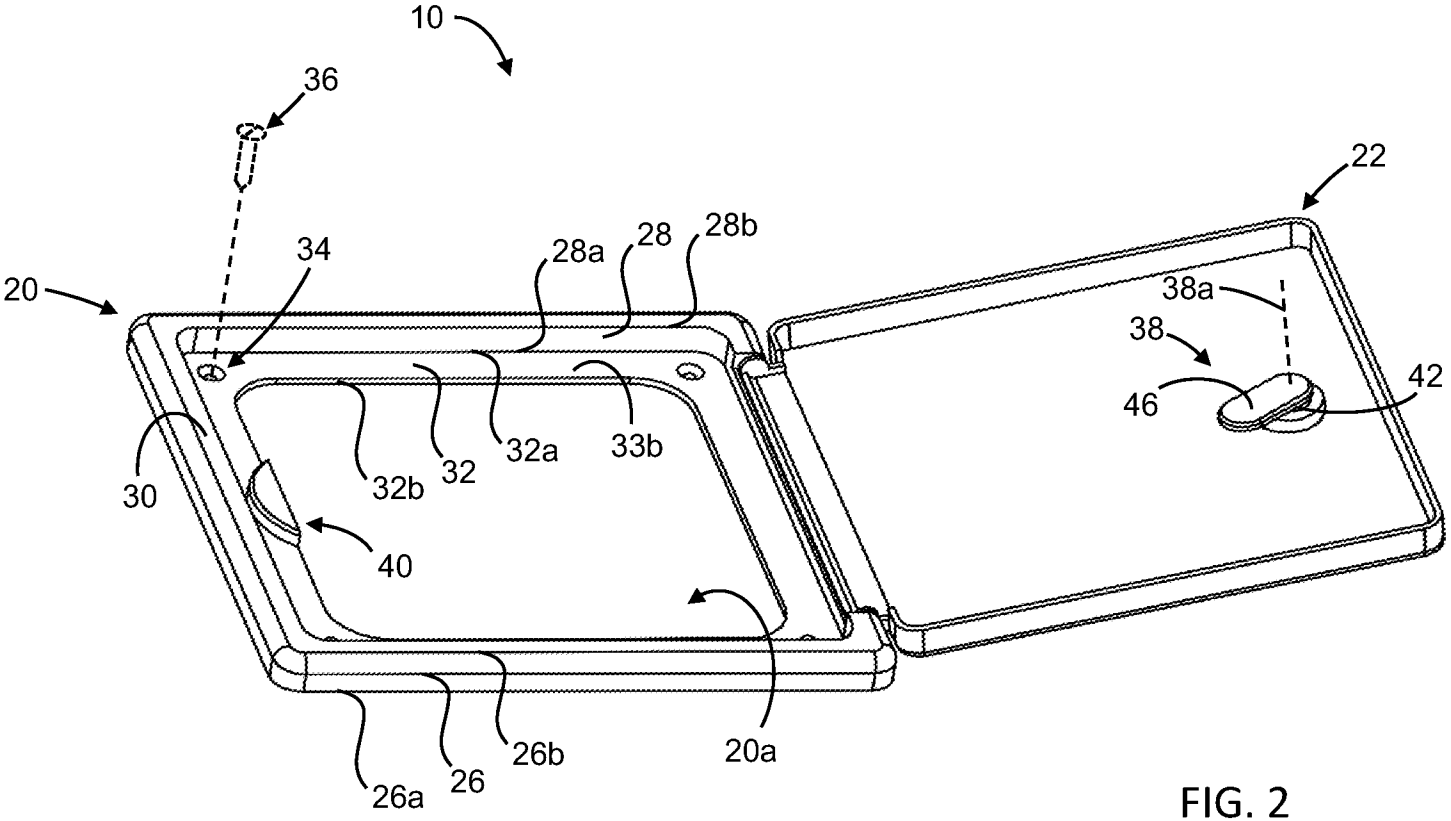
FIG. 2 is another perspective view of the access door assembly of FIG. 1.

Referring to FIG. 2, in the example illustrated, the outside wall 26 extends about the frame opening 20*a*, and has an outside wall bottom edge 26*a* (also referred to as an outer wall bottom edge 26*a*), and an outside wall top edge (also referred to as an outer wall top edge 26*b*) above the outside wall bottom edge 26*a*. The inside wall 28 is spaced laterally inward from the outside wall 26, and has an inside wall bottom edge 28*a* (also referred to as inner wall bottom edge 28*a*) and an inside wall top edge (also referred to as an inner wall top edge 28*b*) above the inside wall bottom edge 28*a*. The top wall 30 extends laterally between the outside wall top edge 26*b* and the inside wall top edge 28*b*. In the example illustrated, the inside and outside walls 26, 28 extend generally parallel to one another, and the top wall 30 extends generally perpendicular to the inside and outside walls 26, 28.

In the example illustrated, a lip 32 is provided attached to the bottom edge 28*a* of the inside wall 28. The lip 32 extends toward the frame opening 20*a* in the interior of the frame assembly 20. The lip 32 can provide for a stop rest for the door 22 when the door 22 is in a closed position.

In the example illustrated, the lip 32 includes a lip outer edge 32*a* joined to the inside wall bottom edge 28*a*, a lip inner edge 32*b* spaced laterally inwardly from the lip outer edge 32*a* and defining at least a portion of a perimeter of the frame opening 20*a*, a generally flat lip bottom surface 33*a* (FIG. 5A) extending between the lip outer edge 32*a* and the lip inner edge 32*b* for bearing against the covering material 14 adjacent the access opening 12, and a generally flat lip top surface 33*b* opposite the lip bottom surface 33*a*. In the example illustrated, the lip top surface 33*b* provides the stop rest for the door 22 when the door 22 is in the closed position. In the example illustrated, the lip 32 extends generally perpendicular to the inside and outside walls 26, 28.

Figure 6:
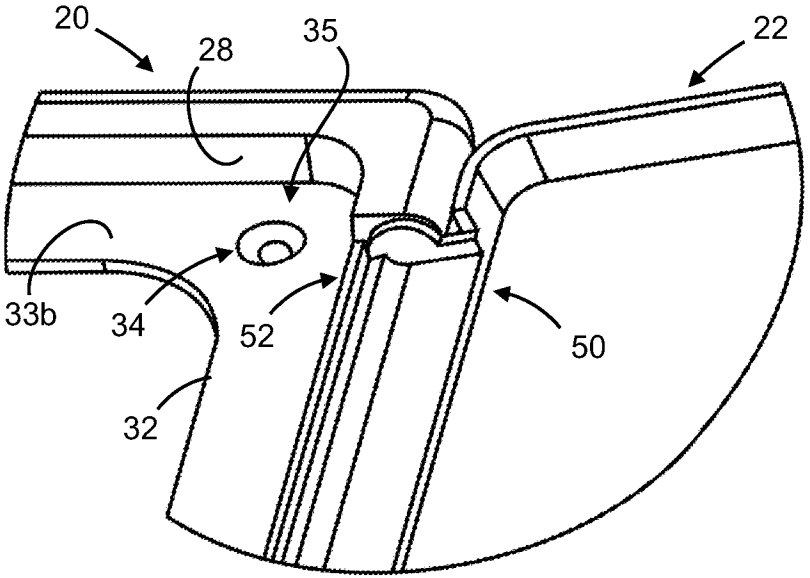
FIG. 6 is a close-up perspective view of a portion of a hinge assembly of the access door assembly of FIG. 1.

Referring to FIG. 2, in the example illustrated, the lip 32 is provided with a means for attaching the access door assembly 10 to the covering material 14. One such means illustrated in the drawings is the provision of a plurality of fastener holes 34 which accept suitable fasteners 36 (e.g. screws 36) for attaching the access door assembly 10 to the covering material 14. In the example illustrated, the fastener holes 34 pass through the lip 32 between the lip top and bottom surfaces 33*a*, 33*b* for receiving the fasteners 36 to secure the frame 20 against the covering material 14. In the example illustrated, each fastener hole 34 is spaced laterally inward from the inner wall 28, and a respective portion 35 (FIG. 6) of the lip top surface 33*b* extends laterally between each fastener hole 34 and the inner wall 28.

In the example illustrated, the holes 34 are countersunk to allow the use of countersunk screws 36 such that when the screws 36 are installed, the heads of the screws 36 lie flush with the top surface 33*b* of the lip 32 and do not interfere with the closing of the door 22.

In the example illustrated, the frame 20 includes four corners where perpendicular sides of the frame 20 intersect, and the lip 32 extends generally continuously from one to another of the perpendicular sides through a respective corner. In the example illustrated, the frame 20 includes four fastener holes 34, each fastener hole 34 adjacent a respective corner of the frame 20.

By providing the means for attaching the access door assembly 10 to the wall or covering material 14 in the lip 32, it may not be necessary to provide strapping in the interior of the cavity of the wall or ceiling. Rather, for gypsum board covering, holes can be drilled through the covering material 14 to match up with the holes 34 in the lip 32, and suitable wall anchors which grip and hold the screws 36 can be placed within the respective holes in the covering material 14. This arrangement may facilitate faster and easier installation of the access door assembly 10 relative to one or more prior art arrangements.

Figure 3:
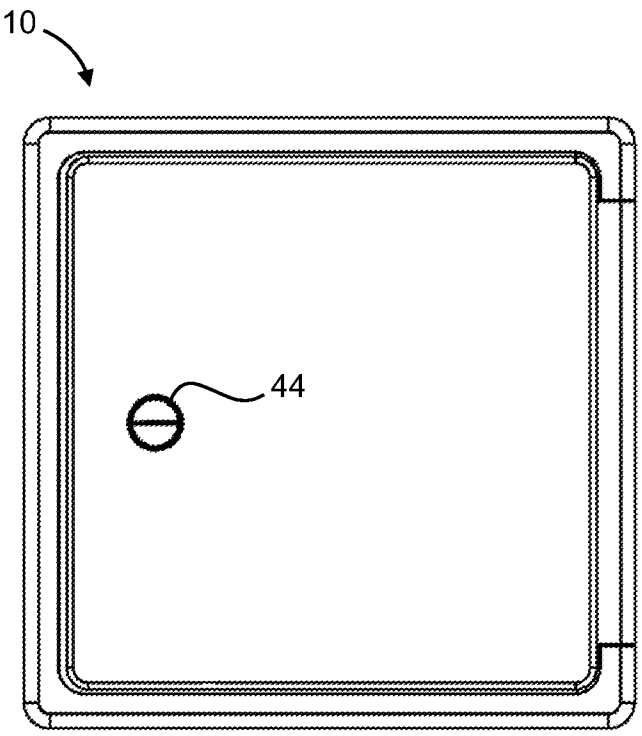
FIG. 3 is a top view of the access door assembly of FIG. 1, with the door assembly shown in a closed condition.

Referring to FIG. 2, in the example illustrated, the door 22 is movable between an open position (shown in FIG. 2) providing access to the frame opening 20*a* and the fastener holes 34, and a closed position (shown in FIG. 3) in which the door 22 covers the frame opening 20*a* and the fastener holes 34. Referring to FIG. 3, in the example illustrated, when in the closed position, the door 22 covers an entirety of the frame opening 20*a* and an entirety of the fastener holes 34. In the example illustrated, when in the closed position, the door 22 is nested within the frame 20 and bounded by the inside wall 28 and the lip 32.

Figure 4:
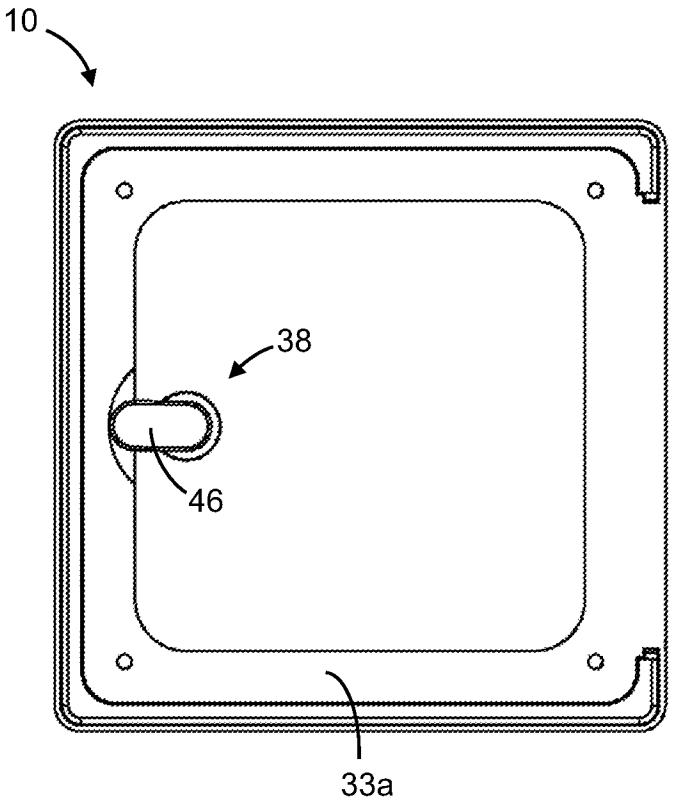
FIG. 4 is a bottom view of the access door assembly of FIG. 1, with the door assembly shown in the closed condition.

In the example illustrated, the door 22 also includes a means for releasably securing the door 22 in the closed position. Referring to FIG. 2, in the example illustrated, the means for releasably securing the door 22 includes a rotatable latch 38 which engages a latch receiving detent 40 provided on the lip 32 of the frame assembly 20. Referring to FIG. 5A, in the example illustrated, the detent 40 includes a detent surface 40*a* (also referred to as an underside surface) fixed to the frame 20 vertically intermediate the lip bottom surface 33*a* and the inside wall top edge 28*b*. In the example illustrated, the latch 38 is rotatably mounted to the door 22. The latch 38 is rotatable relative to the door 22 between an engagement position (shown in FIG. 4) for engagement with the detent surface 40*a* to secure the door 22 to the frame 20 when the door 22 is in the closed position, and a disengaged position (shown in FIG. 1) in which the latch 38 is clear of the detent surface 40*a* for permitting movement of the door 22 between the open and closed positions.

In the example illustrated, in order to facilitate the flush mount of the frame assembly 20 to the covering material 14, the latch receiving detent 40 can be provided as a raised detent 40 which provides a space between the bottom of the detent 40 and the covering material 14 to receive the rotatable latch 38.

In the example illustrated, the detent surface 40*a* is spaced laterally inwardly apart from the inside wall 28. In the example illustrated, the detent surface 40*a* is laterally intermediate the inside wall 28 and the lip inner edge 32*b*.

Referring to FIG. 2, in the example illustrated, the rotatable latch 38 has a rotatable post 42 which is rotatable by turning a knob or key access 44 (FIG. 3) at the top of the rotatable post provided on the exterior surface of the door 22. A tab 46 is attached to the bottom of the rotatable post 42 such that the tab 46 rotates with the rotatable post 42 and engages the underside of the latch receiving detent 40 to releasably secure the door 22 in the closed position. In the example illustrated, when the door 22 is in the closed position, the tab 46 is vertically intermediate the lip bottom surface 33*a* and the detent surface 40*a*. In the example illustrated, when the door 22 is in the closed position and the latch 38 is in the engagement position, the tab 46 is spaced laterally inwardly apart from the inside wall 28.

In order to provide a more secure engagement of the tab 46 and the latch receiving detent 40, the tab 46 may be provided with a raised ridge which engages with a recess provided in the underside of the latch receiving detent 40. As the tab 46 is rotated when moving the latch 38 to the closed position, the raised ridge rides over the underside surface of the latch receiving detent 40 until it drops into the recess and helps to hold the door 22 in the closed position. To open the door 22, the knob or key access 44 is rotated to move the latch 38 toward the open position, which rotates the attached rotatable post 42 and tab 46 until the raised ridge on the tab 46 disengages from recess of the latch receiving detent 40 and allows the door 22 to be opened.

Referring to FIGS. 5A to 7, in the example illustrated, a hinge connection between the frame assembly 20 and the door 22 is illustrated. In the example illustrated, the door 22 is provided with a first part of a hinge assembly 50 along one edge and the frame assembly 20 is provided with a matching second part of the hinge assembly 52 along one edge. Referring to FIG. 7A, in the example illustrated, the first part of the hinge assembly 50 has a generally circular hinge member 54 with hinge pins 56 (FIG. 5B) protruding from both ends of the generally circular hinge member 54. Referring to FIG. 7B, the second part of the hinge assembly 52 include a cutout 58 in the frame channel 24 of the frame assembly 20 sized to accept the generally circular hinge member 54 of the door 22. Hinge pin receiving holes 60 (FIG. 5A) are provided in each end of the cutout 58 to receive the hinge pins 56 of the first part of the hinge assembly 50. The hinge pins 56 in the hinge pin receiving holes 60 securely hold the door 22 to the frame assembly 20 and allow it to rotate from the open to the closed position. The provision of the first and second parts of the hinge assembly 50 and 52 on the edges of the door 22 and frame assembly 20, respectively, can allow the door to 22 to fully open and provide access to the full dimensions of the frame opening 20*a*. This can help allow for a smaller dimensioned door assembly for an equivalent opening relative to one or more of the prior art assemblies.

Figure 5B:
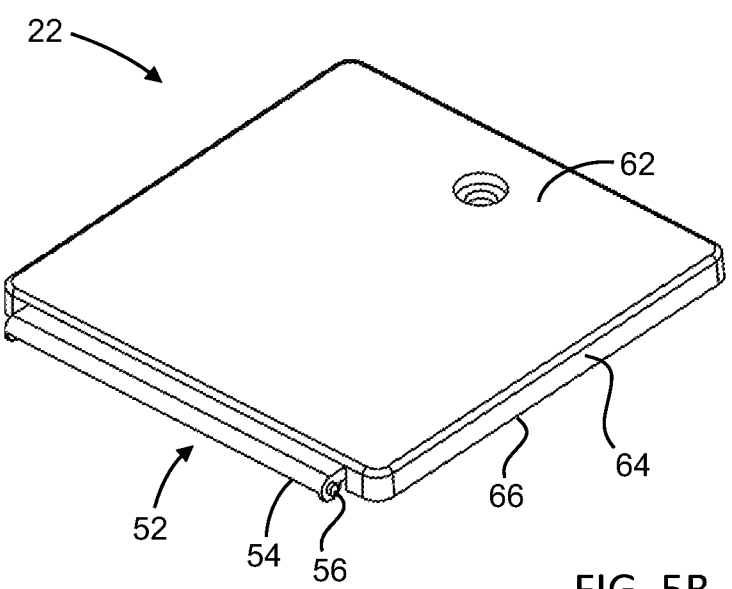
FIG. 5B is a perspective view of a top of a door portion of the access door assembly of FIG. 1.
Figure 5A:
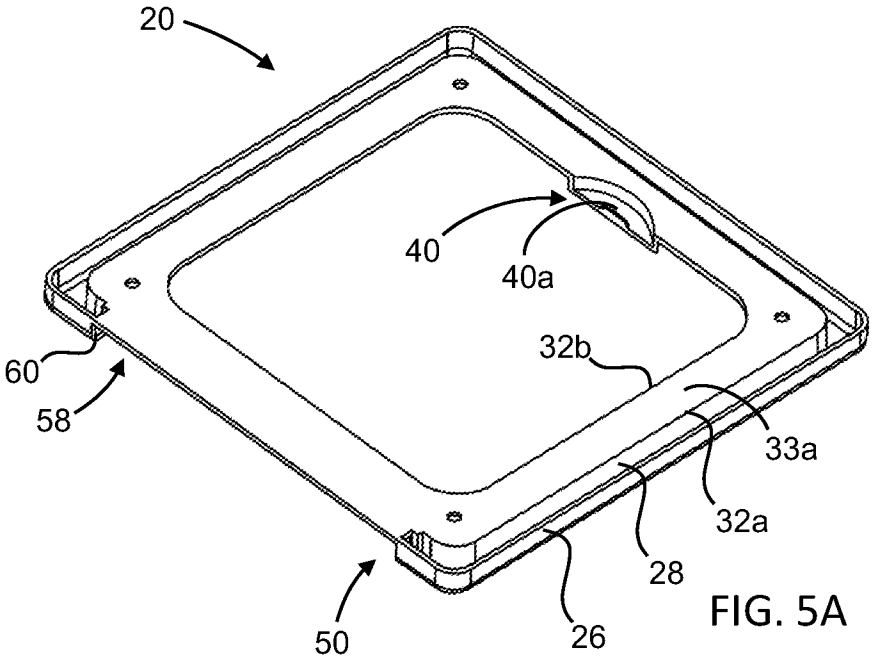
FIG. 5A is a perspective view of a bottom of a frame portion of the access door assembly of FIG. 1.
Figure 7A:
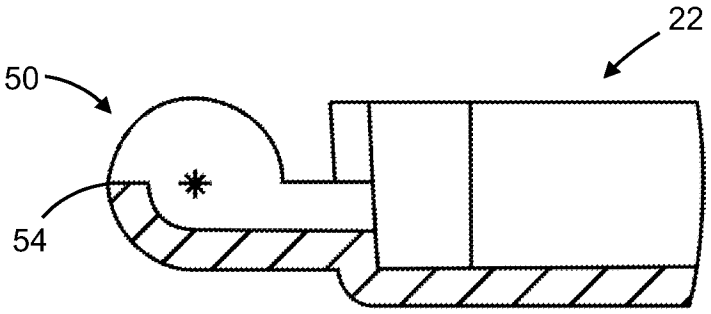
FIG. 7A is a cross-sectional view of a door portion of the hinge assembly of the access door assembly of FIG. 1.
Figure 7B:
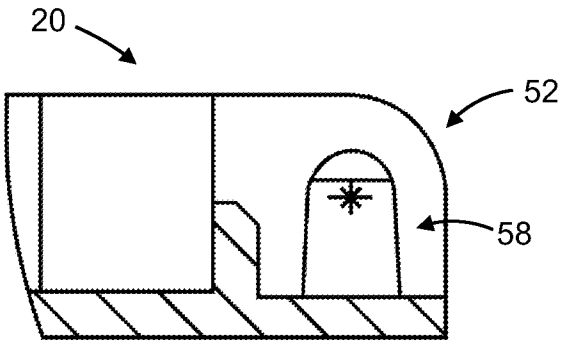
FIG. 7B is a cross-sectional view of a frame portion of the hinge assembly of the access door assembly of FIG. 1.

Referring to FIG. 5B, in the example illustrated, the door 22 has a top surface 62 (also referred to as a door top surface 62) and a door wall 64 (also referred to as skirt 64) extending downwardly from the top surface 62 around the edge of the top surface 62. In the example illustrated, when the door is in the closed position, the door top surface 62 is generally parallel with the lip top surface 33*b*. In the example illustrated, the latch 38 is rotatable about a latch axis 38*a* normal to the door top surface 62. In the example illustrated, the skirt 64 extends from a perimeter of and perpendicular to the door top surface 62. In the example illustrated, a height of the skirt 64 is about equal to a height of the inside wall 28 above the lip 32 (i.e. from the lip top surface 33*b* to the inside wall top edge 28*b*). In this way, when the access door assembly 10 is in the closed position, the lower edge 66 of the skirt 64 rests against the lip 32, and can provide a flush, finished appearance to the access door assembly 10. In the example illustrated, when the door 22 is in the closed position, the lower edge 66 of the skirt 64 rests laterally intermediate the inside wall 28 and the fastener holes 34.

The provision of the lower edge 66 of the skirt 64 of the door 22 resting against the lip 32 of the frame assembly 20 may also allow the interface between the door 22 and the lip 32 to be made airtight or soundproof. For example, if desired, resilient sealing material such as a rubber strip could be provided on either the lower edge 66 or the lip 32 to provide for airtight or soundproof sealing between the lower edge 66 and the lip 32.

It will be appreciated by those of skill in the art that the height of the walls 64 and 28 can be varied to give a higher or lower profile to the access door assembly 10 as desired. Preferably, the height of the walls 28 and 64 can be selected to allow the access door assembly 10 to match DECORA™ electrical outlets and switch plates to allow the access door assembly 10 to appear as another such plate. In addition, the access door assembly 10 may be provided in a number of different sizes, depending upon the application. For example, for shut off valves and connectors for services such as natural gas, a 6 inch by 6 inch panel is commonly used, while for clean out fittings for DWV and shut off valves for the main water supply, sizes up to 12 inches by 12 inches or larger may be used. The frame 20 can have four intersecting, perpendicular sides of generally equal length, and the length of each side can be between about 6 inches and about 12 inches. The access door of the present invention may be easily adapted to such a variety of sizes.

The access door assembly of the present invention is molded from any suitable thermosetting or thermoplastic material such as polyvinylchloride, polystyrene, polyamides, or ABS. Preferably, the access door assembly of the present invention can be molded from an ABS material which can be colored to a suitable color to match the desired decor.

The presently disclosed access door assembly can provide numerous advantages relative to one or more previously known access door assemblies. It can be of less weight and cost compared to one or more of the prior metal door assemblies. In addition, it can be easier to install, and may not require additional strapping around the wall opening to support the access door assembly. When compared to one or more of the prior plastic door assemblies, the presently disclosed access door assembly can provide for a larger opening access and may be easier to install. In addition, the presently disclosed access door assembly may have an increased life expectancy.

Although various preferred embodiments of the present invention have been described herein in detail, it will be appreciated by those of skill in the art that variations may be made thereto without departing from the spirit of the invention or the scope of the appended claims.

The invention claimed is:

1. A molded access door assembly for an access opening in a covering material of a wall or ceiling, the assembly comprising:

a) a frame defining a frame opening, the frame positionable against the covering material with the frame opening in alignment with the access opening, the frame including:

i) an outer wall extending about the frame opening, the outer wall having an outer wall bottom edge for positioning adjacent the covering material, and an outer wall top edge above the outer wall bottom edge, ii) an inner wall spaced laterally inward from the outer wall and extending about the frame opening, the inner wall having an inner wall bottom edge for position adjacent the covering material, and an inner wall top edge above the inner wall bottom edge, iii) a top wall extending laterally between the outer wall top edge and the inner wall top edge; and iv) a lip including:

a lip outer edge joined to the inner wall bottom edge, a lip inner edge spaced laterally inwardly from the lip outer edge and defining at least a portion of a perimeter of the frame opening, a generally flat lip bottom surface extending between the lip outer edge and the lip inner edge for bearing against the covering material adjacent the access opening, a generally flat lip top surface opposite the lip bottom surface, and a plurality of fastener holes passing through the lip between the lip top and bottom surfaces for receiving fasteners to secure the frame against the covering material, each fastener hole spaced laterally inward from the inner wall, and a respective portion of the lip top surface extending laterally between each fastener hole and the inner wall; and b) a molded door hingedly connected to the frame, the door movable between an open position providing access to the frame opening and the fastener holes, and a closed position in which the door is nested within the frame and bounded by the inner wall and the lip, and in which the door covers the frame opening and the fastener holes.

2. The assembly of claim 1, wherein the lip top surface provides a stop rest for the door when the door is in the closed position.

3. The assembly of claim 2, wherein the door includes a door top surface, and a skirt extending from a perimeter of and perpendicular to the top surface for resting on the lip when the door is in the closed position.

4. The assembly of claim 3, wherein a bottom edge of the skirt rests laterally intermediate the inner wall and the fastener holes when the door is in the closed position.

5. The assembly of claim 1, wherein the lip bottom surface and the outer wall bottom edge lie in a common bottom plane.

6. The assembly of claim 5, wherein the assembly is bounded by the common bottom plane.

7. The assembly of claim 1, wherein the inner and outer walls extend generally parallel to one another, and each of the top wall and the lip extend generally perpendicular to the inner and outer walls.

8. The assembly of claim 1, further comprising:

a) a detent surface fixed to the frame vertically intermediate the lip bottom surface and the inner wall top edge; and b) a latch rotatably mounted to the door, the latch rotatable relative to the door between an engagement position for engagement with the detent surface to secure the door to the frame when the door is in the closed position, and a disengaged position in which the latch is clear of the detent surface for permitting movement of the door between the open and closed positions.

9. The assembly of claim 8, wherein the detent surface is spaced laterally inwardly apart from the inner wall.

10. The assembly of claim 8, wherein the detent surface is laterally intermediate the inner wall and the lip inner edge.

11. The assembly of claim 8, wherein the latch includes a rotatable post mounted to the door and a tab fixed to the post for engagement with the detent surface, and wherein when the door is in the closed position, the tab is vertically intermediate the lip bottom surface and the detent surface.

12. The assembly of claim 11, wherein when the door is in the closed position and the latch is in the engagement position, the tab is spaced laterally inwardly apart from the inner wall.

13. The assembly of claim 8, wherein the door has a door top surface generally parallel to the lip top surface when the door is in the closed position, and the latch is rotatable about a latch axis normal to the door top surface.

14. The assembly of claim 1, wherein the frame has four intersecting, perpendicular sides of generally equal length, and the length of each side is between about 6 inches and about 12 inches.

15. The assembly of claim 1, wherein the frame includes four corners where perpendicular sides of the frame intersect, and the lip extends generally continuously from one to another of the perpendicular sides through a respective corner, and wherein the frame includes four fastener holes, each fastener hole adjacent a respective corner.

16. A molded access door assembly for an access opening in a covering material of a wall or ceiling, the assembly comprising:

a) a frame defining a frame opening, the frame positionable against the covering material with the frame opening in alignment with the access opening, the frame including a lip extending about a perimeter of the frame opening for bearing against the covering material adjacent the access opening, and a plurality of fastener holes passing through the lip for receiving fasteners to secure the frame against the covering material; and b) a molded door hingedly connected to the frame, the door movable between an open position providing access to the frame opening and the fastener holes and a closed position in which the door covers the frame opening and an entirety of the fastener holes, wherein the door has a door top surface and a skirt extending from a perimeter of and perpendicular to the door top surface, and wherein when the door is in the closed position, the door top surface overlies the frame opening and the fastener holes and the skirt rests on the lip laterally outwardly of the fastener holes, and further comprising: (a) an engagement surface fixed to the frame; and (b) a latch rotatably mounted to the door, the latch rotatable relative to the door between an engagement position for engagement with the engagement surface to secure the door to the frame in the closed position, and a disengaged position in which the latch is clear of the engagement surface for permitting movement of the door between the open and closed positions, and wherein when the door is in the closed position and the latch is in the engagement position, the engagement surface and the latch are positioned laterally inwardly of the skirt of the door.

* * * * *